US006392153B1

(12) United States Patent
Horwatt et al.

(10) Patent No.: US 6,392,153 B1
(45) Date of Patent: May 21, 2002

(54) ELECTRICAL CONDUCTIVE ASSEMBLY

(75) Inventors: Steven W. Horwatt; George A. Hattrich, both of West Chester; Jeffrey S. Borke, Middletown; Jeffrey A. Jones, Morrow, all of OH (US)

(73) Assignee: Equistar Chemicals, LP, Houston, TX (US)

( * ) Notice: Subject to any disclaimer, the term of this patent is extended or adjusted under 35 U.S.C. 154(b) by 0 days.

(21) Appl. No.: 09/216,025

(22) Filed: Dec. 18, 1998

(51) Int. Cl.[7] ..... H01B 7/00; H01B 11/02

(52) U.S. Cl. ..... 174/110 R; 174/113 R; 174/120 R; 174/121 A

(58) Field of Search ..... 174/110 R, 110 N, 174/110 PM, 110 FC, 120 R, 120 AR, 120 SR, 121 A, 36

(56) References Cited

U.S. PATENT DOCUMENTS

| | | | | |
|---|---|---|---|---|
| 3,571,490 A | | 3/1971 | Bunish et al. | 174/113 |
| 3,852,518 A | * | 12/1974 | Wargotz et al. | 174/120 SR |
| 3,973,187 A | * | 8/1976 | Cereijo et al. | 324/61 R |
| 4,017,228 A | * | 4/1977 | Cereijo et al. | 425/71 |
| 4,058,669 A | * | 11/1977 | Nutt et al. | 174/34 |
| 4,075,421 A | * | 2/1978 | McCullough | 174/120 SC |
| 4,359,436 A | * | 11/1982 | Henderson et al. | 264/40.6 |
| 4,483,808 A | * | 11/1984 | Dillow et al. | 264/22 |
| 4,576,993 A | * | 3/1986 | Tamplin et al. | 525/240 |
| 4,732,939 A | * | 3/1988 | Hoshi et al. | 525/106 |
| 4,913,962 A | * | 4/1990 | Wllkus et al. | 428/372 |
| 4,947,081 A | * | 8/1990 | Ohiwa et al. | 313/509 |
| 5,162,609 A | * | 11/1992 | Adriaenssens et al. | 174/34 |
| 5,342,695 A | * | 8/1994 | Tsurutani et al. | 428/516 |
| 5,364,898 A | * | 11/1994 | Lee, Jr. et al. | 524/265 |
| 5,378,856 A | | 1/1995 | Allen | 174/120 R |
| 5,410,106 A | | 4/1995 | Nishino et al. | 174/105 R |
| 5,412,012 A | | 5/1995 | Horwatt et al. | 524/265 |
| 5,418,272 A | * | 5/1995 | Kawabata et al. | 524/436 |
| 5,439,965 A | | 8/1995 | Horwatt et al. | 524/371 |
| 5,521,009 A | * | 5/1996 | Ishikawa et al. | 428/375 |
| 5,563,377 A | * | 10/1996 | Arpin et al. | 174/121 A |
| 5,670,748 A | * | 9/1997 | Gingue et al. | 174/120 R |
| 5,841,072 A | * | 11/1998 | Gagnon | 174/110 F |

OTHER PUBLICATIONS

Engineering Design Guide (3rd Edition), by C & M Corporation, published in 1992, all.*

* cited by examiner

*Primary Examiner*—Dean A. Reichard
*Assistant Examiner*—William H. Mayo, III
(74) *Attorney, Agent, or Firm*—Jonathan L. Schuchardt

(57) ABSTRACT

An electrical conductive assembly including an electrical conductor and an annular laminate insulator surrounding the electrical conductor. The annular laminate insulator includes an inner ply of a first polymeric composition and an outer ply of a second polymeric composition wherein the outer ply second polymeric composition has a hardness in excess of the inner ply first polymeric composition and wherein the abrasion resistance of the laminate is in excess of the combined individual abrasion resistance of the inner ply and outer plies. The annular laminate is flame retardant and stabilized against thermal oxidation by the inclusion of a flame retardant and a thermal antioxidant. The polymers of the first and second polymeric compositions are thermosetting resins, crystalline thermoplastics having a melting point of at least about 130° C. or amorphous thermoplastics having a glass transition temperature of at least about 130° C.

3 Claims, 1 Drawing Sheet

ELECTRICAL CONDUCTIVE ASSEMBLY

BACKGROUND OF THE DISCLOSURE

1. Field of the Invention

The present invention is directed to an insulated electrical conducting assembly which includes an electrical conductor and an insulating annular laminate surrounding the conductor which meets the requirements imposed on electrical conducting assemblies utilized in the engine compartments of road vehicles.

2. Background of the Prior Art

Insulation of electrical conducting assemblies, of which the most common example is cables, employed in road vehicles must meet several requirements to ensure proper performance of the vehicle engine during operating conditions. These requirements include all those imposed upon electrical cables generally as well as those particularly critical to road vehicle engine performance. Among the requirements of electrical conducting assembly insulation that are particularly critical to vehicle engine performance are heat aging, flame resistance and abrasion resistance.

The first of these requirements, heat aging, requires the insulation of road vehicle cables to be resistant to thermal oxidation. Specifically, the polymer or polymers included in the insulation composition must be resistant to the degradative effects of extended exposure to the elevated temperature environment of a road vehicle engine compartment. Those skilled in the art are aware that extended exposure of polymeric resins to high temperature leads to thermal oxidation which degrades the polymer. This is commonly referred to as "heat aging."

Thus, a particularly important test to which road vehicle cables are subjected is heat aging resistance. In this test, two test cable samples are subjected to elevated temperature over long periods of time. For example, road vehicle cables are subjected to the so-called short term aging test, set forth in ISO International Standard 6722, Paragraph 10.1. In this test a test cable is subjected to a temperature equal to the sum of the class rating temperature and 25° C. for a period of 240 hours. The class rating temperature varies from 85° C. to 250° C. depending upon the location where the cable is disposed. Thus, the test temperature ranges from 110° C.±2° C. to 275° C.±4° C. At the end of this period the cable assembly is subjected to a winding test in a freezing chamber during which time the cable visually inspected to insure that the insulation is undisturbed. Thereafter, the electrical effectiveness of the cable is tested.

Alternatively, the cable is subjected to a long term aging test. This test is set forth in ISO 6722, Paragraph 10.2. In this test two cable samples are subjected to the temperature equivalent to the class rating for 3,000 hours. The test temperature thus varies between 85° C.±2° C. and 250° C.±4° C. depending upon the location of the cable in the vehicle. Thereupon, the cable is subjected to a winding test at room temperature and then judged as in the short term aging test.

Heat aging, a problem successfully addressed in the United States, which has more stringent requirements than those imposed in foreign countries since engines of U.S. manufactured vehicles are, on average, larger and enclosed in smaller engine compartments, is a growing problem in countries where, until recently, engines were smaller and enclosed in larger compartments. In these countries, heat aging is a growing concern in the design of automobile and other road vehicle cable insulation.

A second major concern in the design of road vehicle cable insulation is abrasion resistance. The insulation currently in use in cables employed in foreign built vehicles meet abrasion resistance testing standards. However, these insulators do not meet the stringent heat aging requirements of newly designed vehicles. Therefore, the insulation of cables designed for use in future vehicles are currently being redesigned to meet higher heat aging requirements. These new insulators will be required to still meet stringent abrasion resistance testing. Specifically, cables used in foreign built vehicles must meet the Scrape Abrasion Resistance Test of International Standard ISO 6722, as set forth in Paragraph 9.2. That test, like the heat aging testing, discussed above, of ISO 6722 is incorporated herein by reference.

Flame resistance or more precisely, resistance to flame propagation, a requirement common to cables used in other applications, is a critical property requirement of electrical conductive assemblies employed in road vehicles. Indeed, the aforementioned ISO 6722 International Standard concerning road vehicle cables includes, in Paragraph 12, a flame propagation resistance test.

The above remarks establish the need in the art for a new electrical conducting assembly insulator which, in addition to meeting all the other requirements imposed on an electrical conducting assembly insulator, possesses the requisite heat aging characteristics and meets stringent abrasion resistant tests increasingly imposed on cables utilized in road vehicles.

A particularly pertinent prior art reference which discloses insulators for electrical conduits employed in road vehicles is U.S. Pat. No. 5,412,012. That patent describes a flame retardant insulation and jacketing composition useful for wire and cable products which exhibits improved adhesion to the metal conductor. That insulating composition includes a crosslinked ethylene copolymer which may be an ethylene-vinyl ester copolymer, an ethylene-alkyl acrylate copolymer, an ethylene-alkyl methacrylate copolymer or mixtures thereof. The composition further includes a hydrated inorganic filler, an alkoxysilane and stabilizers to protect against the deleterious effects of heat, air and light.

Another pertinent reference is U.S. Pat. No. 5,439,965 which describes a flame retardant and abrasion resistant crosslinkable composition useful as wire and cable insulation. The composition includes an ethylene-vinyl acetate copolymer having a vinyl acetate content of 5 to 12 wt. %, a halogenated flame retardant additive, antimony trioxide as a synergist and an organic peroxide.

Many prior art references illustrate the utilization of electrical conductors covered by multilayer insulators wherein at least one of the layers imparts flame resistivity to the insulator. U.S. Pat. No. 5,670,748 is illustrative of a teaching of such an insulating laminate. The '748 patent sets forth a flame retardant and smoke suppressant electrical conducting assembly insulator which comprises an electrical conductor surrounded by an inner layer of a polyolefin or polyurethane foam and an outer layer of a halogenated polymeric material, surrounding the inner layer, which renders the insulating laminate flame retardant and smoke suppressant.

U.S. Pat. No. 5,410,106 illustrates another electrical conducting assembly employing a multilayer insulator. The assembly of the '106 patent is utilized in an electrical feed cable in which a plurality of electrical conductors are insulated with an inner layer of an ethylene-α-olefin copolymer surrounded by a protective outer layer of a fiberglass, carbon fiber or composite tape inorganic fiber cloth.

A similar design is disclosed in U.S. Pat No. 3,571,490. The '490 patent sets forth a flame resistant electrical cable which includes a plurality of insulated conductors, each conductor including a metal strand surrounded by a vulcanized copolymer or terpolymer of ethylene and propylene which acts as a flame resistant electrical insulator. The insulator, an ethylene-propylene polymer, i.e. EPM or EPDM, is covered with a layer of neoprene or chlorosulfonated polyethylene.

U.S. Pat. No. 5,378,856 describes a transmission cable insulator employed in the distribution of electrical power in commercial and residential buildings. The insulator includes non-halogenated polyethylene, which in a preferred embodiment is high density polyethylene; non-halogenated ethylene-vinyl acetate; a flame retardant; a processing aid; a flame retardant enhancer, such as a silicone fluid; a lubricant and flame retardant enhancer, such as magnesium stearate; and an antioxidant, such as hindered phenolics. The insulator, in contact with the electrical conductor, in one embodiment includes a cable jacket wrapped about the insulator. The cable jacket, not laminated to the insulator, is not identified in the patent.

BRIEF SUMMARY OF THE INVENTION

A new electrical conducting assembly has now been developed which, in addition to meeting all other requirements imposed upon electrical conduits used in road vehicle engine compartments, provides improved abrasion resistance, resistance to thermal oxidation and flame resistance.

In accordance with the present invention an insulated electrical conducting assembly is provided. The assembly includes an electrical conduit and an electrical insulating annular laminate which comprises an inner layer of a first polymeric composition and an outer layer of a second polymeric composition. The polymeric compositions are characterized by the requirements that (1) the hardness of the second polymeric composition is greater than the hardness of the first polymeric composition; (2) the abrasion resistance of the laminate is greater than the sum of the individual abrasion resistances of both the inner layer and the outer layer; (3) at least one of the first and second polymeric compositions is flame retardant; and (4) at least one of the first and second polymeric compositions is stabilized against thermal oxidation.

BRIEF DESCRIPTION OF THE DRAWINGS

The present invention will be better understood by reference to the drawings of which

DETAILED DESCRIPTION

Figure 1:
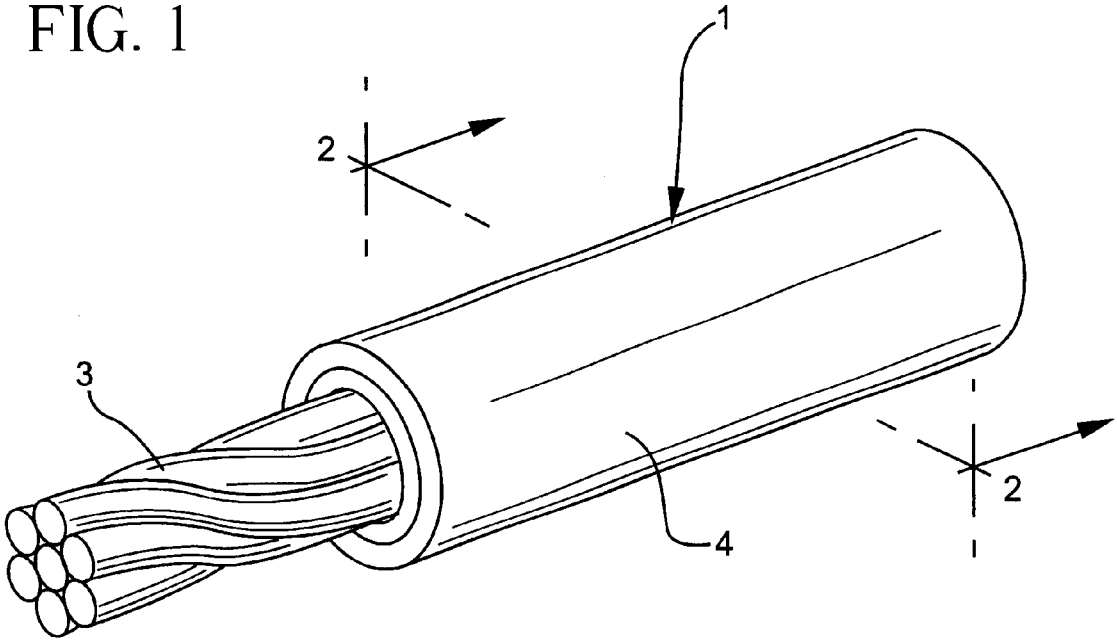
FIG. 1 is a perspective view of an electrical conducting assembly in accordance with the present invention.
Figure 2:
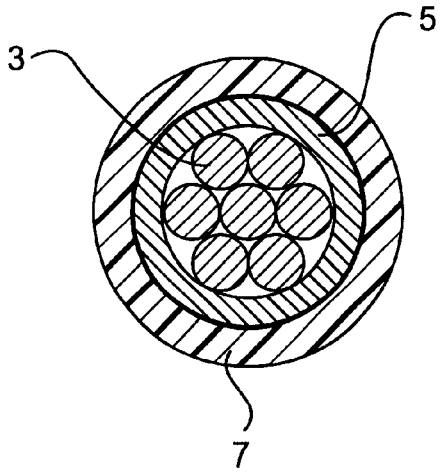
FIG. 2 is a cross-sectional view taken along line 2—2 of FIG. 1.

The electrical conducting assembly of the present invention is generally indicated at 1. The assembly 1 includes an electrical conductor 3. The electrical conductor 3 is of metal construction, the metal being a good conductor of electrical current. Thus, any metal that effectively conducts electricity may be utilized for this purpose. For example, metals such as copper, copper coated with tin or nickel, stainless steel, aluminum and the like may be employed as the electrical conductor 3. Of these, copper is particularly preferred.

The assembly 1 also includes an annular laminate insulator generally indicated at 4. The laminate insulator 4 includes an inner layer 5 of a first polymeric composition and an outer layer 7 of a second polymeric composition. It is emphasized that, unlike jacketed insulators of the prior art, the insulator of the present invention must be a laminate wherein the inner and outer layers 5 and 7 are bonded to each other.

The outer layer 7, the second polymeric composition, is limited by the restriction that it be harder than the first polymeric composition. Hardness is quantitatively defined by Shore D Hardness, as set forth in ASTM Test Procedure D-2240. Preferably, the second polymeric composition has a hardness of at least about 3 Shore D hardness units, as defined in the aforementioned ASTM test, greater than the first polymeric composition. More preferably, the second polymer composition has a hardness of at least 5 Shore D hardness units greater than the Shore D hardness of the first polymeric composition. It is furthermore preferred that the absolute Shore D hardness of the second polymeric composition be at least about 60 Shore D hardness units. More preferably, the minimum Shore D hardness of the second polymeric composition is at least about 65 Shore D hardness units.

Another characteristic of the first and second polymeric compositions is that the polymers of these compositions are stable against thermal oxidation, that is, exhibit the requisite vehicle manufacturers' heat aging requirements. The adequacy of antioxidant capacity is generally met by such tests as short term aging over 240 hours and long term aging over 3,000 hours, as set forth in ISO Test Standard 6722, discussed above.

One means of providing requisite heat aging characteristics is the addition of at least one antioxidant stabilizer. Antioxidant stabilizers employed in at least one of the first and second polymeric compositions include hindered phenols and thioesters. Other antioxidant stabilizers such as hydroquinolines, i.e. polymerized 1,2-dihydro-2,2,4-trimethyl quinoline, and tris(3,5-di-t-butyl-4-hydroxy benzyl)isocyanate, may also be utilized. Mixtures of two or more of any of the aforementioned antioxidants, as well as two or more specific compounds within any of the three aforementioned genuses of antioxidant stabilizers, may be used as well.

A particularly preferred hindered phenol useful in providing thermal antioxidant properties is tetrakis(methylene (3,5-di-tert-butyl-4-hydroxyhydrocinnamate))methane. Other hindered phenols useful as thermal antioxidants in the polymeric compositions of the present invention include 2,6-di-t-butyl-prcresol, octadecyl 3,5-di-t-butyl-4-hydroxyhydrocinnamate, 2,2'-methylene bis(6-t-butyl-4-methyl phenol), 4,4'-butylidene bis(6-t-butyl-3-methyl phenol), 1,3,5-trimethyl-2,4,6-tris(3,5-di-t-butyl-4-hydroxybenzyl)benzene and 2,2'-methylene bis(4-methyl-6-t-butyl phenol).

Useful thermal antioxidants of the thioester class include pentaerythritol tetrakis(betalaurylthiopropionate), thiodiethylene bis(3,5-di-t-butyl-4-hydroxyhydrocinnamate), dilauryl-3,3'-thiodipropionate dimyristylthiodipropionate and bisalkyl sulfides.

A particularly preferred antioxidant formulation includes both hindered phenol and thioester constituents. For example, a composition that incorporates tetrakis(methylene (3,5-di-t-butyl-4-hydroxyhydrocinnamate))methane, pentaerythritol tetrakis(betalaurylthiopropionate) and thiodiethylene bis(3,5-di-t-butyl-4-hydroxyhydrocinnamate) is often used in compositions within the scope of the present invention.

A further characteristic of the laminate insulator of the present invention is that it is flame retardant. Flame retardancy of the laminate insulator is provided by the incorporation of at least one flame retardant addition in at least one of the first and second polymeric compositions. Flame retardant additives within the-scope of the present invention include halogenated organic compounds, inorganic fillers or combination of the two known in the art for providing flame retardancy.

In a preferred embodiment wherein at least one halogenated organic compound is utilized as the flame retardant additive, that compound is preferably one in which at least one halogen atom is bonded to a ring which may be aromatic or cycloaliphatic. The halogen substituents can be attached to monocyclic, bicyclic or multicyclic rings. The halogen itself is preferably chloride or bromine with bromine being particularly preferred. The compound may include other functional groups if those other functional groups do not adversely affect the processing or the physical characteristics of the composition.

Examples of halogenated compounds substituted on aromatic or cycloaliphatic rings include: perchloropentacyclodecane; Diels-Alder adducts of hexachloropentadiene with "enes" such as maleic anhydride; hexabromobenzene; pentabromoethylbenzene 2,4,6-tribromophenol; tribromophenol allyl ether; octabromodiphenyl; poly(pentabromobenzyl) acrylate; pentabromodiphenyl ether; octabromodiphenyl ether; decabromodiphenyl ether; tetrachlorobisphenol A; tetrabromobisphenol A; tetrachlorophthalic anhydride; tetrabromophthalic anhydride;

hexachloroendomethylenetetrahydrophthalic acid; ethylenebis(tetrabromophthalimide); and hexabromocyclododecane.

A highly preferred class of halogenated organic compounds within the scope of the present invention has the general formula

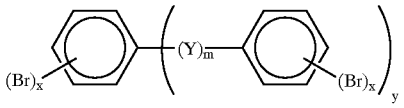

where x is an integer of 3 to 6; m is 0 or 1; y is 0 or 1; and Y is oxygen or a bivalent aliphatic radical $C_nH_{2n}$, are thus where n is an integer of 1 to 6. Preferred meaning of Y

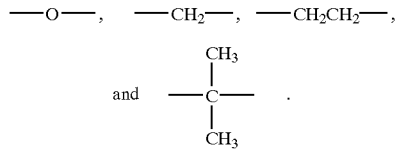

Specific halogenated compounds preferably include high concentrations of halogen in order to minimize the amount of the flame retardant compound required in the composition. The halogen content is preferably about 65% and more preferably about 75% of the halogenated organic compound. Preferably, the halogenated compound or compounds are solid particles having a particle size not in excess of about 10 microns. Such particles are easily dispersed and when compositions containing these additives are extruded, produce extradites having a smooth appearance.

Halogenated organic compounds within the scope of the present invention have a preferred melting point above about 200° C. Even more preferably, the melting point is above about 250° C. Compounds melting at these relatively high temperatures minimize volatilization and loss of flame retardant properties during processing and extrusion.

Of the above-mentioned illustrations of preferred halogenated compounds, decabromodiphenyl ether (DBDPO), which is within the contemplation of the preferred generic brominated aromatic compound, set forth infra, is particularly preferred. DBDPO contains 82–83% bromine and melts over a range of 290°–310° C.

It is preferred that an inorganic filler be included with one of the aforementioned halogenated flame retardants to act as a synergist. Although an inorganic filler is not essential, the inclusion of an inorganic filler synergist improves flame retardancy and reducing the concentration of halogenated compound required for effective flame retardancy. Among the inorganic filler synergists preferred for use with halogenated organic compounds in the present invention are antimony trioxide, antimony pentoxide, antimony silicates, boron compounds, tin oxide, zinc oxide, zinc borate, aluminum trioxide and aluminum trihydroxide. Of these, antimony trioxide is most preferred.

When an inorganic filler is employed as a synergist with a halogenated organic compound the weight ratio of halogenated organic compound to synergist is usually in the range of from about 2:1 to about 5:1. More preferably, this ratio is in the range of between about 2.5:1 and about 4:1.

Another class of preferred flame retardant additives are hydrated inorganic fillers. These fillers are effective flame retardants since the water of hydration chemically bound to these inorganic fillers is released endothermically upon combustion or ignition to impart flame retardancy. Preferred hydrated inorganic fillers include hydrated alumina, hydrated magnesia, hydrated calcium silicate and hydrated magnesium carbonates. Of these, hydrated alumina is particular preferred.

When flame retardancy is provided by an inorganic hydrated filler, the filler is present in the polymeric composition in a concentration of between about 80 to about 400 parts per 100 parts of polymer, i.e. about 80 phr to about 400 phr. More preferably, the hydrated inorganic filler concentration is between about 80 to about 200 phr.

The annular laminate of the electrical conductive assembly of the present invention must, of course, remain solid at the service temperature to which it is exposed. Thus, the polymers of the first and second polymeric compositions must either be thermosetting resins, which do not melt, or thermoplastic polymers which, if crystalline, have a melting point above the service temperature or, if amorphous, have a glass transition temperature above the service temperature. In a preferred embodiment the service temperature is at least about 130° C.

In the preferred embodiment wherein the first and/or second polymeric compositions are amorphous or crystalline thermoplastics the thermoplastic polymers are the same or different and are polyolefins, polyamides, polyesters, polyacetals, polycarbonates, polyfluorocarbons and the like, consistent with a melting point or a glass transition temperature in excess of the service temperature.

In preferred embodiments where the polymer of the first and second polymeric compositions are thermoplastics having a melting point or glass transition temperature of at least about 125° C., it is particularly preferred that the thermoplastic be a polyolefin. Preferred polyolefins, useful in the first and second polymeric compositions, include high density polyethylene and polypropylene.

Thermosetting polymers which may be utilized in the first and/or second polymeric compositions of the present invention include thermoplastic polymers which are crosslinked by chemical or radiation means. Preferred chemical crosslinking means include contact of the thermoplastic with at least one organic peroxide which is thermally decomposed. Another preferred chemical crosslinking means is contact of the thermoplastic with an organosilane followed by hydrolysis. Radiation crosslinking means is preferably provided by exposure of the thermoplastic to ionizing radiation, usually gamma rays or electron beam radiation.

Thermoplastics particularly preferred for conversion to thermosetting resins by chemical or radiation means are polyolefins. Specifically such polyolefins as low density polyethylene, linear low density polyethylene, high density polyethylene, ethylene-vinyl esters copolymers, ethylene-alkyl acrylate copolymers and ethylene-alkyl methacrylate copolymers are most often employed in this application. The degree of crosslinkage, determined by the degree of insoluble gel, is generally in excess of about 50%. Preferably, the degree of crosslinkage is between about 60% and about 95%.

Of the aforementioned polyolefins that are subjected to crosslinkage, low density polyethylene, ethylene-vinyl ester copolymers, ethylene-alkyl acrylate copolymers and ethylene-alkyl methylacrylate copolymers are particularly preferred.

In the preferred embodiment where the crosslinked polymer results from the chemical or radiation crosslinkage of an ethylene-vinyl ester copolymer, the vinyl ester monomer is preferably a vinyl ester of a $C_2$–$C_6$ aliphatic carboxylic acid, such as vinyl acetate, vinyl propionate, vinyl butyrate, vinyl pentanoate or vinyl hexanoate.

In the case where an alkyl acrylate or an alkyl methacrylate monomer is utilized with ethylene to form the preferred class of ethylene-alkyl acrylate or alkyl methacrylate copolymer, the monomer is preferably any of the $C_1$–$C_6$ alkyl esters of acrylic or methacrylic acid. Thus, the preferred ester is methyl, ethyl, propyl, butyl, pentyl or hexyl acrylate or methacrylate.

In the preferred embodiment wherein crosslinking occurs by chemical means utilizing organic peroxide compound decomposition, an organic peroxide is incorporated into the polymeric composition at a temperature below its decomposition temperature. The composition is thereupon activated by being heated to a temperature at or above the decomposition temperature of the organic peroxide, curing the thermoplastic constituent of the polymeric composition. This crosslinking process involving organic peroxide decomposition may optionally include a crosslinking coagent, such as triallyl cyanurate, to increase cure effectiveness.

The concentration of organic peroxide usually does not exceed 8 parts by weight per 100 parts by weight of the thermoplastic. Preferably, this concentration is 1 to 6 phr, with a concentration of 1.5 to 5 phr particularly preferred.

Of the organic peroxides which may be utilized in the curing process, tertiary organic peroxides are preferred. Of the tertiary organic peroxides, dicumyl peroxide and $\alpha,\alpha'$-bis(t-butylperoxy)diisopropylbenzane are particularly preferred.

In another preferred embodiment, wherein a thermosetting resin is provided by contact of an organosilane with a thermoplastic followed by hydrolysis, it is preferred to employ a silicon-containing thermoplastic polymer wherein the silicon is provided in branches off the main chain followed by contact with water wherein crosslinkage occurs.

In a preferred embodiment, the thermoplastic polymer utilized in organosilane induced crosslinkage is an olefin-vinyl silicon copolymer. Still more preferably, the copolymer is $C_1$–$C_4$ olefin-vinyl silane. Still more preferably, the copolymer is $C_1$–$C_2$ olefin-vinyl alkoxysilane. The vinylalkoxysilanes of the aforementioned copolymer, within the scope of the present invention, include gamma-methacryloxypropyltrimethoxysilane, vinyltris(2-methoxyethoxy)silane, vinyltrimethoxysilane and vinyltriethoxysilane. Of these, vinyltrimethoxysilane and vinylethoxysilane are particularly preferred.

The hydrolysis step, during which curing occurs, can occur naturally by exposure to even trace concentrations of water in the atmosphere. However, curing can be accelerated by immersion of the silicon-containing thermoplastic into a high water-concentration medium, such as a water bath, a moisture saturated atmosphere or the like, maintained at elevated temperatures. Hydrolysis curing, in a particularly preferred embodiment, may also be accelerated by the use of a curing catalyst. One such preferred catalyst is dibutyltin dilaurate. Other hydrolysis curing catalysts known in the art may, alternatively, also be utilized.

A third preferred method of providing thermosetting polymers within the scope of the present invention involves radiation crosslinkage of a thermoplastic polymer. Radiation is preferably provided by gamma rays or an electron beam providing the requisite ionizing radiation. When radiation is utilized in crosslinkage of a thermoplastic, a crosslinking coagent, which accelerates the curing process, such as a triacrylate or a trimethacrylate, is preferably included in the thermoplastic composition. For example, trimethylolpropane trimethacrylate is preferably employed as a crosslinking coagent.

In addition to the above-discussed components one or both of the first and second polymeric compositions may include a further additive in those compositions which include an inorganic filler. Those skilled in the art are aware that binding of polymers to inorganic fillers represent a major hurdle in the development of effective polymeric compositions. Thus, an additional preferred additive is one which provides this function. A class of additives that aids in bonding inorganic fillers to the polymers of the first and second polymeric compositions are alkoxysilanes.

Alkoxysilanes useful in the first and second polymeric compositions of the present invention include lower alkyl-, alkenyl-, alkynyl-, and aryl-alkoxysilanes containing from 1 to 3 alkoxy substituents having from one to six and, more preferably, one to three carbon atoms. Alkoxysilanes having two or three $C_{1-3}$ alkoxy substituents, e.g. methoxy, ethoxy, propoxy or combinations thereof, are particularly advantageous. Illustrative silanes include methyltriethoxysilane, methyltris(2-methoxyethoxy)silane, dimethyldiethoxysilane, ethylmethoxysilane, vinyltris(2-methoxyethoxy)silane, phenyltris(2-methoxyethoxy)silane, vinyltrimethoxysilane and vinyltriethoxysilane, and gamma-methacryloxypropyltrimethoxysilane.

It is preferred to use vinyl alkoxysilanes. Of the vinyl alkoxysilanes, gamma-methacryloxypropyltrimethoxysilane of the formula

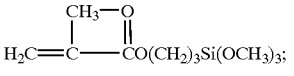

vinyltris(2-methoxyethoxy)silane of the formula $H_2C{+}CHSi(OCH_2CH_2OCH_3)_3$; vinyltrimethoxysilane of the formula $H_2C{=}CHSi(OCH_3)_3$; and vinyltriethoxysilane of the formula $H_2C{=}CHSi(OCH_2CH_3)_3$ are especially useful. Vinyltrimethoxysilane and vinyltriethoxysilane are particularly advantageous.

The alkoxysilane is present in an amount from 0.5 to 5 phr and, more preferably, in an amount from 0.75 to 4 phr.

Although the annular laminate must possess requisite abrasion resistance, heat aging resistance and flame retardancy, provided by the aforementioned polymers and additives, these characteristics may be imparted to the laminate by the inclusion of these polymers and additives in one or both of the first and second polymeric compositions. That is, flame retardant and antioxidant additives may be provided in the first, the second or both polymeric compositions. Similarly, the polymers of the first and second polymeric compositions may both be thermoplastic, both thermosetting or one may be thermoplastic and the other thermosetting.

In one preferred embodiment the first polymeric composition, constituting the inner ply, is a thermosetting polymeric composition while the second polymeric composition, constituting the outer ply, is thermoplastic.

In a further preferred embodiment the first polymeric composition includes at least one flame retardant additive and at least one thermal antioxidant and the second polymeric composition includes at least one thermal antioxidant.

The following examples are given to illustrate the scope of the present invention. Because these examples are provided for illustrative purposes only, the claims of the present invention should not be deemed limited thereto.

EXAMPLE 1

A seven strand 22 AWG electrical conductor, wherein each conductor was 30 AWG, was insulated with a two-ply laminate. The two-ply laminate, prepared by coextrusion, included a 10 mils thick inner layer first polymeric composition adjacent to the electrical conductor.

This inner ply first polymeric composition comprised an ethylene-vinyl acetate copolymer, which included 18% by weight vinyl acetate, having a melt index of 2.4; 120 parts hydrated alumina; 1.2 parts vinyltrimethoxysilane; 1.7 parts α,α'-bis(t-butylperoxydiisopropylbenzene); 1.75 parts tetrakis(methylene(3,5-di-tert-butyl-4-hydroxyhydrocinnamate))methane; 1.2 parts thiodiethylene bis(3,5-di-tert-butyl-4-hydroxyhydrocinnamate) and 0.3 parts pentaerythritol tetrakis(betalaurylthiopropionate), where the number of parts were by weight, based on 100 parts by weight of the ethylene-vinyl acetate copolymer.

The first polymeric composition was formulated by blending the aforementioned ingredients in a Banbury® mixer for 3 to 5 minutes at a temperature of about 110° C. to 125° C. The molten polymer was extruded onto the electrical conductor. The thus formed insulated wire was then passed through a vulcanization tube maintained at a temperature of about 400° F. wherein the peroxide constituent decomposed causing crosslinkage of the ethylene-vinyl acetate copolymer.

Thereupon, a second polymeric composition was extruded over the first polymeric composition. The second polymeric composition was high density polyethylene having a melt index of 0.8, as determined by ASTM D-1238, and a density, as determined by ASTM D-2389, of 0.946 to which tetrakis(methylene(3,5-di-t-butyl-4-hydroxyhydrocinnamate))methane (1.75 parts) thiodiethylene bis(3,5-di-t-butyl-4-hydroxyhydrocinnamate) (1.2 parts) and pentaerythritol tetrakis(betalauryl thiopropionate) (0.3 parts) was added. The parenthesized parts being by weight, based on 100 parts by weight of high density polyethylene. The thickness of the HDPE second polymeric composition outer ply was 2 mils (0.002 in.).

The first and second polymeric compositions were subjected to Shore D hardness testing, in accordance with ASTM Standard Test D-2240. It was determined that the Shore D hardness of the first polymeric composition was 55. The second polymeric composition hardness was found to be 60 Shore hardness units.

The thus formed electrical conduit assembly was subjected to the Scrape Abrasion Resistance Test as defined by ISO Test Standard 6722. ISO 6722 provides test methods, dimensions and requirements for single core 60V cables intended for use in road vehicles. Test Standard ISO 6722 is incorporated herein by reference. The Scrape Abrasion Resistance Test measures the number of cycles required for a specified needle to abrade through cable insulation. The insulation laminate of the electrical cable assembly of this example required 984 cycles for the needle to abrade through the insulation.

The results of this example are included in the Table below.

Comparative Example 1

A 22 AWG, seven strand conductor, identical to the conductor used in Example 1, was insulated with a polymeric composition identical to the first polymeric composition of Example 1. The annular thickness of the polymeric composition was 10 mils, identical to the thickness of the first polymeric composition of Example 1.

The thus produced cable, having the aforementioned single ply insulator, was subjected to the Scrape Abrasion Resistance Test. The single ply insulator abraded after 45 cycles.

The results of this test are summarized in the Table below.

Comparative Example 2

Comparative Example 1 was identically reproduced except that the annular thickness of the first polymeric composition insulator was increased to 16 mils, a thickness in excess of the total 12 mils thickness of the laminate insulator of Example 1.

The cable prepared in this example was subjected to the Scrape Abrasion Resistance Test. Complete abrasion through the insulator of this example occurred after 128 cycles.

A summary of this example is provided in the Table below.

Comparative Example 3

A 22 AWG, seven strand conductor, identical to the electrical conductors utilized in Example 1 and Comparative Examples 1 and 2, was insulated with a 12 mil thick annular layer of the high density polyethylene (HDPE) second polymeric composition utilized in Example 1.

This 12 mils thick single ply annular layer, identical to the thickness of the laminate insulator of Example 1, in contact with and disposed over the conductor, was tested to determine its abrasion resistance in accordance with the Scrape Abrasion Resistance Test. The HDPE layer was found to have an abrasion resistance of 540 cycles.

This example is included in the Table below.

Comparative Example 4

Comparative Example 3 was identically reproduced except that the annular thickness of the HDPE composition insulator was decreased to 2 mils from the 12 mils thick single ply HDPE composition employed as the insulator of the cable of Comparative Example 3.

The cable of this example was subjected to the Scrape Abrasion Resistance Test and found to have an abrasion resistance of 1 cycle.

This example is included in the Table below.

EXAMPLE 2

Example 1 was identically reproduced but for the thickness of the HDPE second polymeric composition. The outer ply thickness of the HDPE composition was increased to 5 mils, compared to an HDPE outer ply thickness of 2 mils in Example 1.

The insulated cable of this example was tested in accordance with the Scrape Abrasion Resistance Test and found to have a resistance of 1,844 cycles.

This example is included in the Table below.

Comparative Example 5

Comparative Example 3 was identically reproduced except that the annular thickness of the HDPE composition insulator was increased to 16 mils from the 12 mil thick single ply HDPE composition employed as the insulator of the cable of Comparative Example 3.

The cable of this example was subjected to the Scrape Abrasion Resistance Test and found to have an abrasion resistance of 1,383 cycles.

This example is included in the Table below.

EXAMPLE 3

Example 2 was identically reproduced but for the substitution of an impact polypropylene copolymer containing 10% by weight ethylene characterized by a melt flow rate of 2.5, as determined by ASTM D-1238, and a Shore hardness of 65, as determined by ASTM Standard Test D-2240, for the high density polyethylene second polymeric composition. That is, the annular laminator insulator of this example constituted the same crosslinked first polymeric composition, having an annular thickness of 10 mils, surrounded by an annular outer ply of a second polymeric composition constituting the thermoplastic polypropylene copolymer and the same antioxidant additives in the same concentrations utilized in the second polymeric compositions of Examples 1 and 2 having an annular thickness of 5 mils. The cable included a 22 AWG, seven strand conductor, identical to the conductors used in all the previous examples, about which the annular insulator was disposed.

The cable of this example was tested for its abrasion resistance in accordance with the Scrape Abrasion Resistance Test. The abrasion resistance of this cable was 7,055 cycles.

This example is tabulated in the Table below.

Comparative Example 6

An electrical conductor, identical to that used in Example 1, was coated with the same thermoplastic impact polypropylene composition utilized in Example 3 as the outer ply. The resultant 5 mils thick single ply, impact polypropylene insulated cable was tested in accordance with the Scrape Abrasion Resistance Test and was found to have a resistance of 19 cycles.

This example is tabulated in the Table below.

EXAMPLE 4

A masterbatch of low density polyethylene homopolymer having a melt index of 1.0, as measured by ASTM Test Procedure D-1238, and a density of 0.915, as determined by ASTM Test Procedure D-2389, (13.4 parts by weight); decabromodiphenylether (22 parts by weight); antimony trioxide (7.3 parts by weight); talc (4.6 parts by weight); tetrakis(methylene(3,5-di-t-butyl-4-hydroxyhydrocinnamate))methane (1.12 parts by weight); thioethylene bis(3,5-di-t-butyl-4-hydroxyhydrocinnamate) (0.77 parts by weight); pentaerythritol tetrakis (betalaurylthiopropionate) (0.13 parts by weight); and butyltin dilaurate (0.11 parts by weight) was prepared.

This masterbatch was combined with ethylene-vinyltrimethoxysilane copolymer (EVS), wherein vinyltrimethoxysilane comprised 1.8% by weight. The EVS copolymer had a melt index of 1.0, as measured by ASTM Test Procedure D-1238. The EVS copolymer was combined with the masterbatch to form a first polymeric composition such that 87.6 parts of the copolymer were combined with 59.43 parts of the masterbatch and blended in a Banbury® mixer for 3 to 5 minutes at a temperature of 110° C. to 125° C. The resultant melt was extruded onto an electrical conductor identical to that employed in Example 1.

A second polymeric composition, a high density polyethylene composition identical to that used in Example 1, was coextruded over the inner ply first polymeric composition. Like the outer ply second polymeric composition of Example 1, the outer ply was 2 mils in annular thickness.

The so-formed electrical conducting assembly was thereupon placed in a water bath maintained at a temperature of 95° C. for 6 hours to hydrolytically crosslink the inner ply first polymeric composition.

This example is included in the Table below.

Comparative Example 7

An electrical conducting assembly was prepared in accordance with the procedure followed in Example 4 but for absence of coextrusion of the high density polyethylene composition outer ply thereof.

This example is included in the Table below.

EXAMPLE 5

An electrical conductor identical to that employed in Example 1 was covered with an insulating first polymeric composition by extrusion of the composition onto the conductor. The first polymeric composition comprised an ethylene-vinyl acetate copolymer (100 parts) identical to that employed in Example 1; alumina trihydrate (118 parts); vinyltrimethoxysilane (1.7 parts); tetrakis(methylene(3,5-di-t-butyl-4-hydroxyhydrocinnamate))methane (2 parts); thioethylene bis(3,5-di-t-butyl-4-hydroxyhydrocinnamate) (2 parts); and trimethylolpropane trimethacrylate (4.5 parts), all parts being by weight.

The extrusion of the first polymeric composition onto the electrical conductor differed from that of Example 1 by that the extrudate was not passed through a vulcanization tube. In addition, whereas Example 1 involved coextrusion of both a first and a second polymeric composition, this example involved single extrusion of the first polymeric composition onto the conductor.

The thus-formed insulated cable was wound onto a reel. The cable was thereupon unreeled over an electron beam and exposed to a total radiation of 7.5 microrads to provide a crosslinked composition having an annular thickness of 10 mils.

The insulated cable was thereupon coated with a second layer of the same second high density polyethylene composition used in Example 1. The second layer was extruded over the first polymeric composition such that its annular thickness was again 2 mils.

This example is included in the Table below.

Comparative Example 8

An electrical conducting assembly was prepared in accordance with the procedure followed in Example 5 but for the omission of the step of the step of extruding a second layer over the first radiation crosslinked polymeric composition. As such, the assembly was insulated with a 10 mils thick, single ply crosslinked polymeric composition.

This example is summarized in the Table below.

TABLE

| Example No. | Cable Insulator | Thickness, mils | Scrape Abrasion Resistance, cycles |
|---|---|---|---|
| 1 | EVA Peroxide X-linked Inner Ply (10 mils)-HDPF Outer Ply (2 mils) Laminate | 12 | 984 |
| CE1 | EVA Peroxide X-linked | 10 | 45 |
| CE2 | EVA Peroxide X-linked | 16 | 128 |
| CE3 | HDPE | 12 | 540 |
| CE4 | HDPE | 2 | |
| 2 | EVA Peroxide X-linked Inner Ply (10 mils)-HDPE Outer Ply (5 mils) Laminate | 15 | 1844 |
| CE1 | EVA Peroxide X-linked | 10 | 45 |
| CE4 | HDPE | 2 | |
| CE5 | HDPE | 16 | 128 |
| 3 | EVA Peroxide X-linked Inner Ply (10 mils)-PP Outer Ply (5 mils) Laminate | 15 | 7,055 |
| CE1 | EVA Peroxide X-linked | 10 | 45 |
| CE6 | PP | 5 | 19 |
| 4 | EVS-LDPE X-linked Inner Ply (10 mils)-HDPE Outer Ply (2 mils) Laminate | 12 | |
| CE7 | EVS-HDPE X-linked | 10 | |
| CE4 | HDPE | 2 | 1 |
| 5 | EVA Electron Beam X-linked Inner Ply (10 mils)-HDPE Outer Ply (2 mils) Laminate | 12 | |

TABLE-continued

| Example No. | Cable Insulator | Thickness, mils | Scrape Abrasion Resistance, cycles |
|---|---|---|---|
| CE8 | EVA Electron Beam X-linked | 10 | |
| CE4 | HDPE | 2 | 1 |

The above embodiments and examples are given to illustrate the scope and spirit of the present invention. These embodiments and examples will make apparent, to those skilled in the art, other embodiments and examples. Those other embodiments and examples are within the contemplation of the present invention. Thus, the scope of the present invention should be limited only by the appended claims.

What is claimed is:

1. An electrical conductor assembly comprising:

(a) an electrical conductor; and (b) an insulating annular laminate surrounding the conductor;

wherein the laminate comprises:

(i) an inner ply of a crosslinked polyolefin; and (ii) an outer ply of crystalline polyolefin having a melting point of at least about 125° C., wherein the crystalline polyolefin is selected from the group consisting of high density polyethylene and impact polypropylene;

and wherein the laminate incorporates at least one flame retardant and at least one antioxidant and the abrasion resistance of the laminate exceeds the sum of the abrasion resistances of the inner and outer plies.

2. The assembly of claim 1 wherein the crosslinked polyolefin is selected from the group consisting of low density polyethylene, high density polyethylene, linear low density polyethylene, ethylene-vinyl ester copolymers, ethylene-alklacrylate copolymers, ethylene-vinylsilane copolymers, and ethylene-alkylnethacrylate copolymers.

3. The assembly of claim 1 wherein the outer ply has a hardness that is at least 3 Shore D units greater than the hardness of the inner ply.

* * * * *